US007475925B2

(12) United States Patent
Huang et al.

(10) Patent No.: US 7,475,925 B2
(45) Date of Patent: Jan. 13, 2009

(54) COMBINATION STRUCTURE OF BASE PLATE AND ESCUTCHEON

(75) Inventors: Lien-Hsi Huang, Kaohsiung (TW); Kuang-Chun Chiang, Ziguan Shiang (TW)

(73) Assignee: Taiwan Fu Hsing Industrial Co., Ltd. (TW)

( * ) Notice: Subject to any disclaimer, the term of this patent is extended or adjusted under 35 U.S.C. 154(b) by 0 days.

(21) Appl. No.: 11/523,523

(22) Filed: Sep. 20, 2006

(65) Prior Publication Data

US 2008/0067820 A1 Mar. 20, 2008

(51) Int. Cl.
*E05B 1/00* (2006.01)
*E05B 3/00* (2006.01)

(52) U.S. Cl. ..... 292/347; 292/80; 292/87; 292/88; 292/348; 292/353; 292/DIG. 61

(58) Field of Classification Search ..... 292/1, 292/80, 87, 88, 347, 348, 353, 357, DIG. 11, 292/DIG. 48, DIG. 53, DIG. 61, DIG. 63; 70/224

See application file for complete search history.

(56) References Cited

U.S. PATENT DOCUMENTS 517,703 A * 4/1894 Ludwig ..... 292/87
564,661 A * 7/1896 Tollner ..... 292/87
1,128,339 A * 2/1915 McDonald ..... 292/353
2,423,206 A * 7/1947 Schlage ..... 292/357
2,501,940 A * 3/1950 Hibbard ..... 16/425
2,536,494 A * 1/1951 Erkkila ..... 292/357
3,177,024 A * 4/1965 Krook et al. ..... 292/353
3,427,061 A * 2/1969 Gresham et al. ..... 292/353
3,468,568 A * 9/1969 Ulich ..... 403/329
5,088,781 A * 2/1992 Ono et al. ..... 292/347
5,575,516 A * 11/1996 Baumgarten ..... 292/353
5,634,675 A * 6/1997 Mo ..... 292/80
5,732,578 A * 3/1998 Kang ..... 70/224
6,260,733 B1 * 7/2001 Eimerman ..... 220/759
6,425,613 B1 * 7/2002 Shen ..... 292/348

* cited by examiner

*Primary Examiner*—Carlos Lugo
(74) *Attorney, Agent, or Firm*—Troxell Law Office, PLLC

(57) ABSTRACT

A combination structure of base plate and escutcheon comprises a base plate, a fastener and an escutcheon. The base plate has a plate and a ring-like wall surrounding the plate, and the fastener has a fastening portion, a fixing portion and a flexible portion connecting the fastening portion and the fixing portion. The fixing portion is installed on the ring-like wall and the base plate is covered with the escutcheon. The escutcheon has a sidewall, an opening and a limited-portion. The opening is formed on the sidewall and exposes the fastening portion of the fastener. The limited-portion of the escutcheon is restrained by the fastening portion of the fastener to prevent the escutcheon disengaging from the base plate.

3 Claims, 6 Drawing Sheets

COMBINATION STRUCTURE OF BASE PLATE AND ESCUTCHEON

FIELD OF THE INVENTION

The present invention relates generally to a combination structure of base plate and escutcheon, and more particularly to a combination structure of base plate and escutcheon having fastener.

BACKGROUND OF THE INVENTION

A base plate for accommodating a lock is usually covered with a escutcheon for fine looking, however if the base plate doesn't fit the escutcheon in size, there are some troubles that happen such as the escutcheon frequently slips or is hard to be removed from the base plate. Recently, a screw is utilized to fix base plate and escutcheon, which not only makes escutcheon-disassembling steps become complicated and inconvenient but also affects the looking of combination structure of base plate and escutcheon.

SUMMARY

An object of the present invention is to provide a combination structure of base plate and escutcheon, which is to install a fixing portion of a fastener on a base plate and then cover the base plate with a escutcheon. A limited-portion located on the escutcheon is restrained by a fastening portion of the fastener so as to prevent the escutcheon disengaging from the base plate thereby enhancing assembly efficiency and assembly reliability.

Yet another object of the present invention is to provide a combination structure of base plate and escutcheon. The escutcheon has an opening to expose the fastening portion of the fastener, by means of pushing the fastening portion of the fastener through the opening the limited-portion of the escutcheon won't be limited by the fastening portion of the fastener to facilitate disengaging the escutcheon from the base plate.

Yet further another object of the present invention is to provide a combination structure of base plate and escutcheon. The fixing portion of the fastener has a position-protruding portion engaging with a position hole of the base plate for which the fastener can be stably coupled to the base plate.

In accordance with the present invention, there is provided a combination structure of base plate and escutcheon comprising a base plate, at lease a fastener and an escutcheon. The base plate has a plate and a ring-like wall surrounding the plate, and the fastener has a fastening portion, a fixing portion and a flexible portion connecting the fastening portion and the fixing portion. The fixing portion is installed on the ring-like wall and the base plate is covered with the escutcheon. The escutcheon has a sidewall, an opening that exposes the fastening portion of the fastener and a limited-portion that is restrained by the fastening portion of the fastener so as to prevent the escutcheon disengaging from the base plate.

DETAILED DESCRIPTION OF THE PRESENT INVENTION

Figure 1:
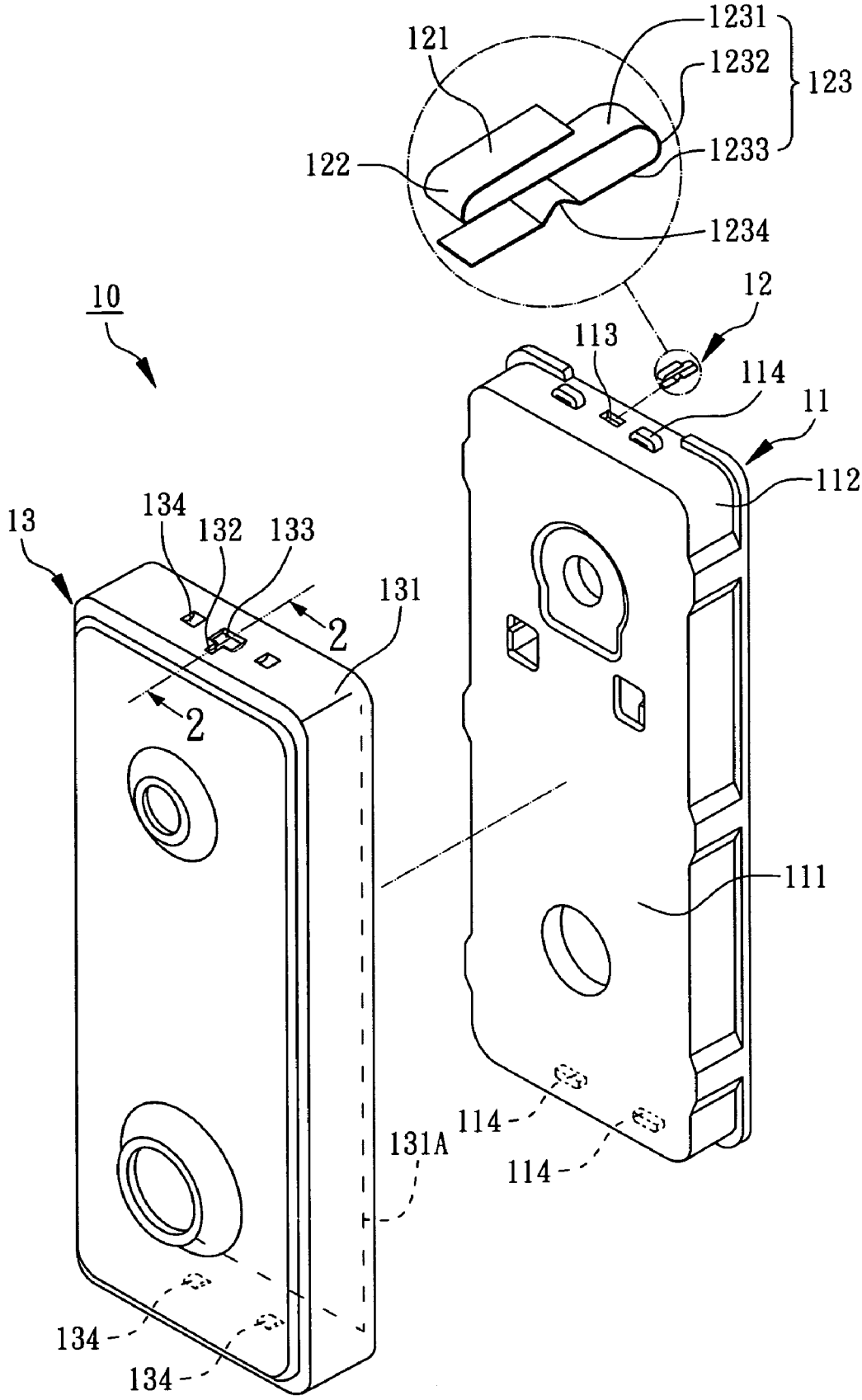
FIG. 1 is a block decomposition diagram of a combination structure of base plate and escutcheon in accordance with the first preferred embodiment of the present invention.
Figure 2:
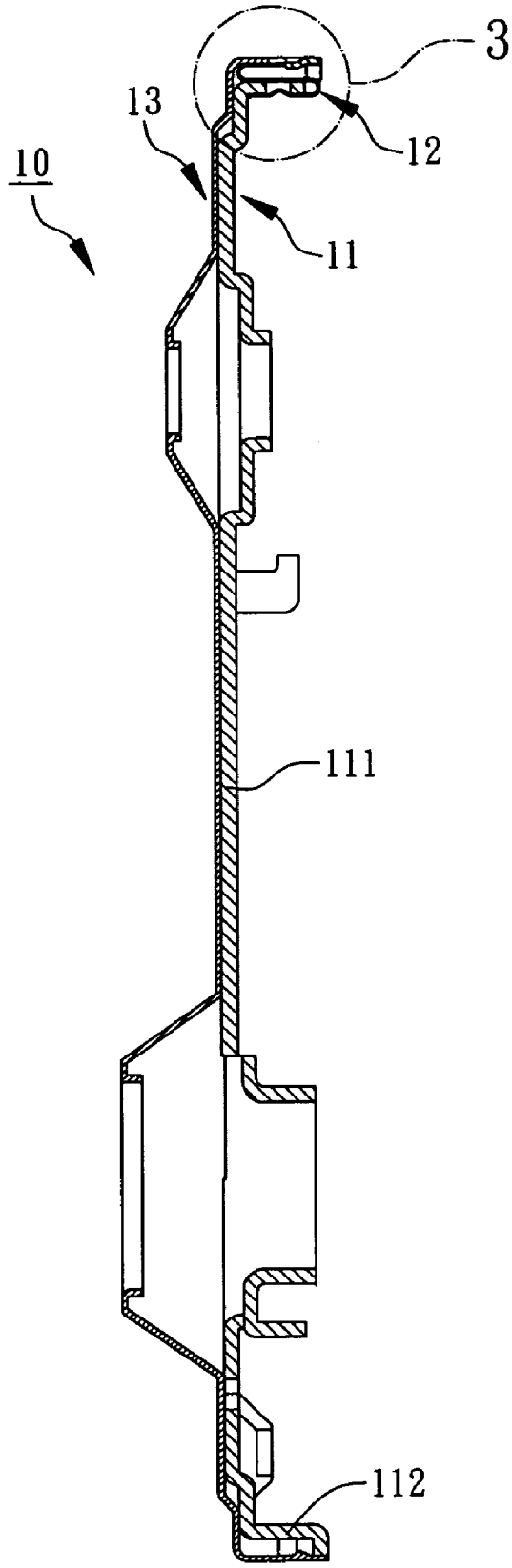
FIG. 2 is a cross-sectional diagram of a combination structure of base plate and escutcheon taken along line 2-2 of FIG. 1.
Figure 3:
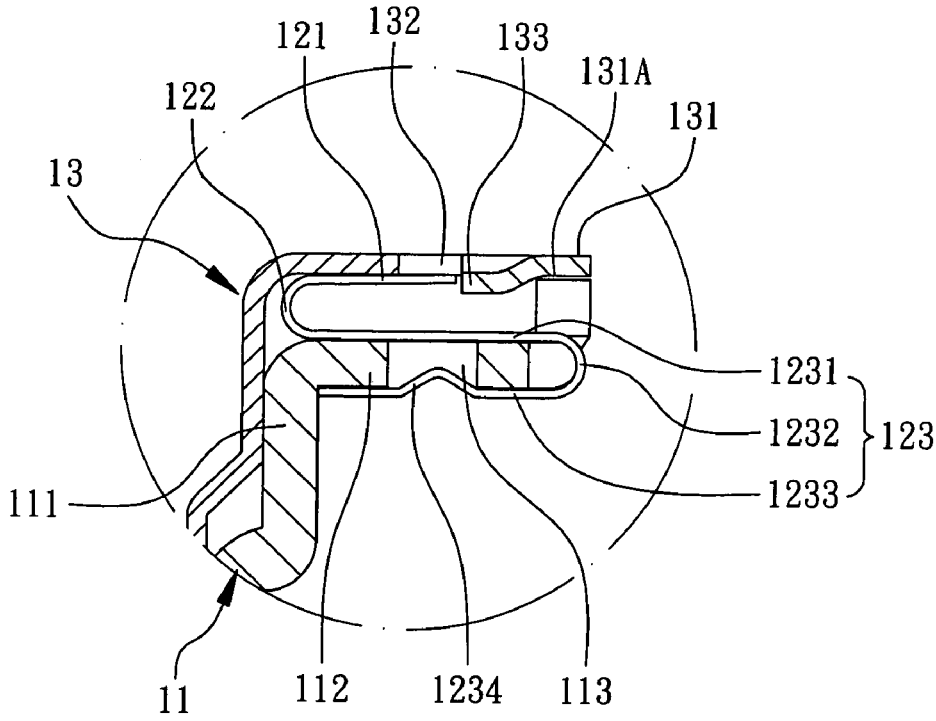
FIG. 3 is a partially enlarged diagram of a combination structure of base plate and escutcheon in accordance with the first preferred embodiment of the present invention.
Figure 4:
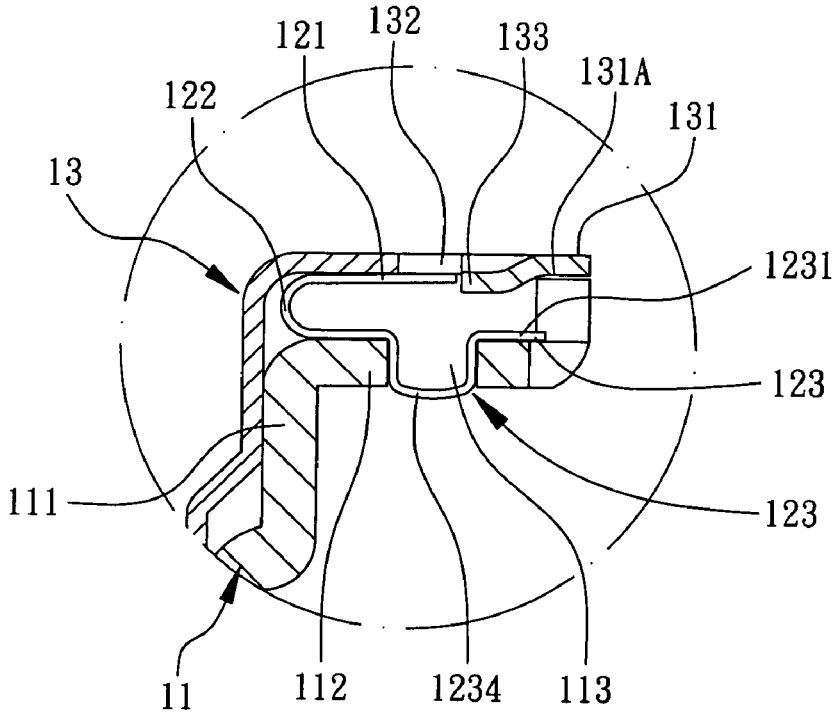
FIG. 4 is a partially enlarged diagram of another combination structure of base plate and escutcheon in accordance with the present invention.

In the first preferred embodiment of the present invention showed in FIG. 1, FIG. 2 and FIG. 3, a combination structure of base plate and escutcheon 10 comprises a base plate 11, a fastener 12 and an escutcheon 13. The fastener 12 is installed on the base plate 11, in this embodiment, the base plate 11 has a plate 111, a ring-like wall 112 (i.e., a ring wall) surrounding the plate 111, at least one position hole 113 and at least one position bump 114, and both the position hole 113 and the position bump 114 are formed on the ring-like wall 112. The fastener 12 has a fastening portion 121, a fixing portion 123 and a flexible portion 122 connecting the fastening portion 121 and the fixing portion 123. The fastener 12 is made of a metal sheet and that can be an s-shape or a u-shape. The fixing portion 123 is installed on the ring-like wall 112 of the base plate 11 and corresponds to the position hole 113. In this embodiment, the fixing portion 123 has a first clip-arm 1231, a bending portion 1232 and a second clip-arm 1233. The bending portion 1232 is utilized to connect the first clip-arm 1231 and the second clip-arm 1233 and the ring-like wall 112 is held by the first clip-arm 1231 and the second clip-arm 1233 hence the fixing portion 123 of the fastener 12 can be coupled to the base plate 11. Furthermore, the fixing portion 123 may have a position-protruding portion 1234 engaged with the position hole 113 of the base plate 11 to increase the coupling strength of the fixing portion 123 and the base plate 11. In this embodiment, the position-protruding portion 1234 is formed on the second clip-arm 1233, otherwise in another embodiment showed in FIG. 4, the position-protruding portion 1234 is formed on the first clip-arm 1231 and there is no need to fabricate the bending portion 1232 and the second clip-arm 1233 thereby saving the fabrication cost of fastener 12. It is desirable to tightly engage the position-protruding portion 1234 with the position hole 113 of the base plate 12 that allows the fixing portion 123 of the fastener 12 to be coupled to the base plate 11, in this embodiment, the position-protruding portion 1234 can be a triangular protrusion, a rectangular protrusion or a circular protrusion. Otherwise in a further embodiment, the fixing portion 123 of the fastener 12 can be directly coupled to the ring-like wall 112 (not shown in the drawing) by applying a coupling element such as adhesive resin, screw or rivet enabling the fastener 12 to be fixed to the base plate 11.

Figure 5:
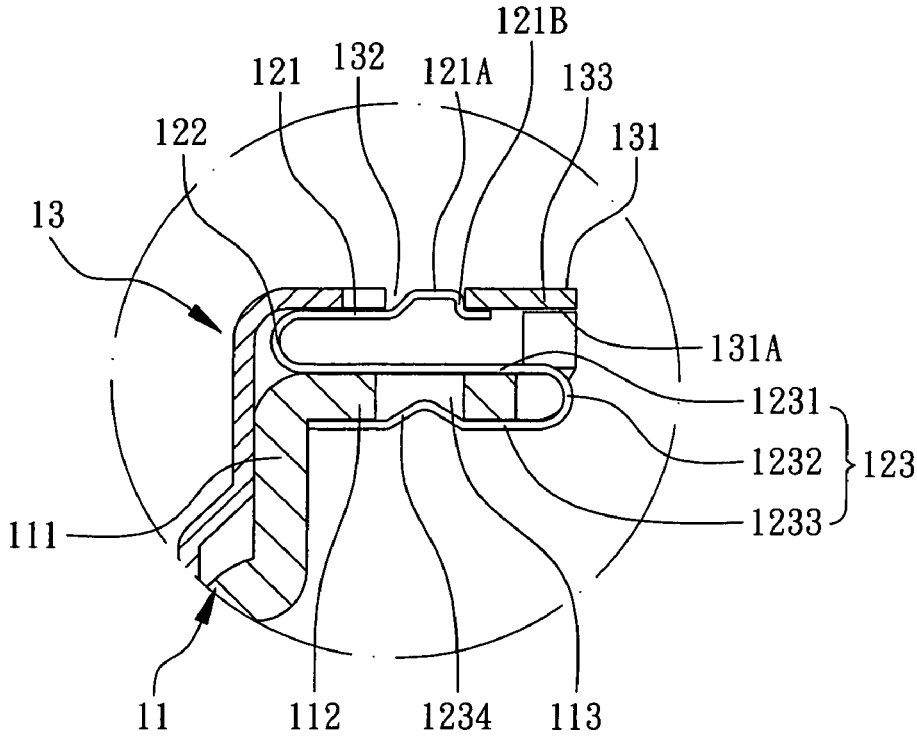
FIG. 5 is a partially enlarged diagram of a further combination structure of base plate and escutcheon in accordance with the present invention.

Referring to FIG. 2, the base plate 11 is covered with the escutcheon 13, and the escutcheon 13 has a sidewall 131, an opening 132, a limited-portion 133 and at least one engaging bump 134. The opening 132 is formed on the sidewall 131 and exposes the fastening portion 121 of the fastener 12. The limited-portion 133 is restrained by the fastening portion 121 of the fastener 12 and the engaging bump 134 is engaged with the position bump 114 of the base plate 11. In this embodiment, the limited-portion 133 is a protrusion formed on an inner side 131A of the sidewall 131 and that is restrained by the fastening portion 121 of the fastener 12. Otherwise, in another embodiment of FIG. 5, the limited-portion 133 is even with the sidewall 131 and the fastening portion 121 of the fastener 12 has a bend-protruding portion 121A that engages with the opening 132 of the escutcheon 13 and restrains the limited-portion 133. Besides, the bend-protruding portion 121A has a limited-end 121B and the limited-portion 133 of the escutcheon 13 can be restrained by the limited-end 121B so as to prevent the escutcheon 13 disengaging from the base plate 11.

Figure 6:
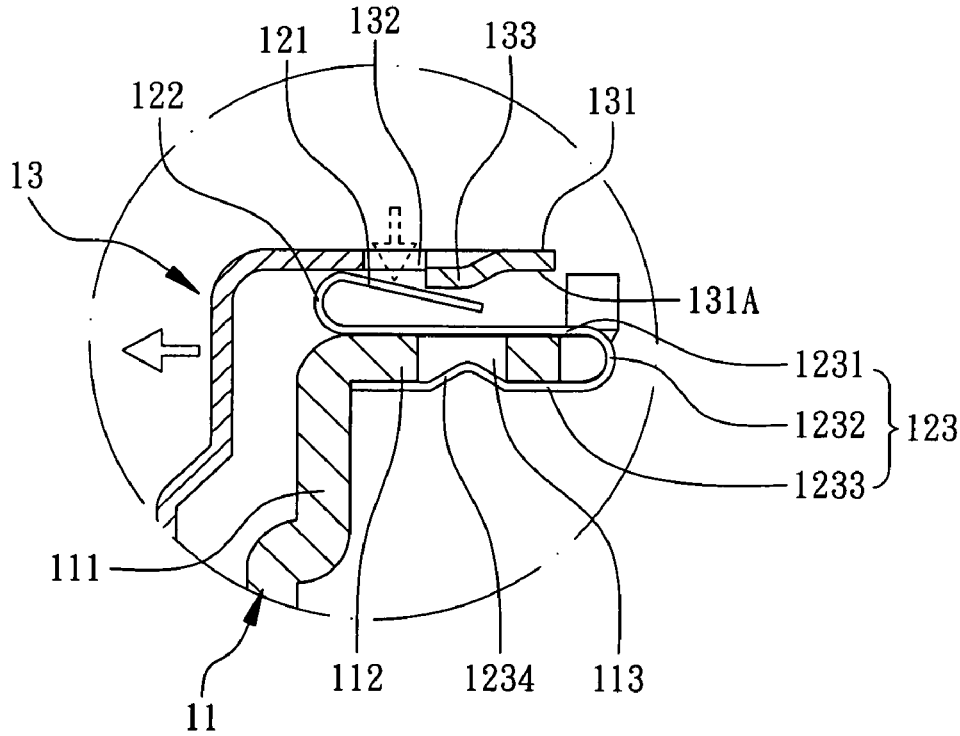
FIG. 6 is the motions showing which an escutcheon disengages from a base plate in accordance with the first preferred embodiment of the present invention.
Figure 7:
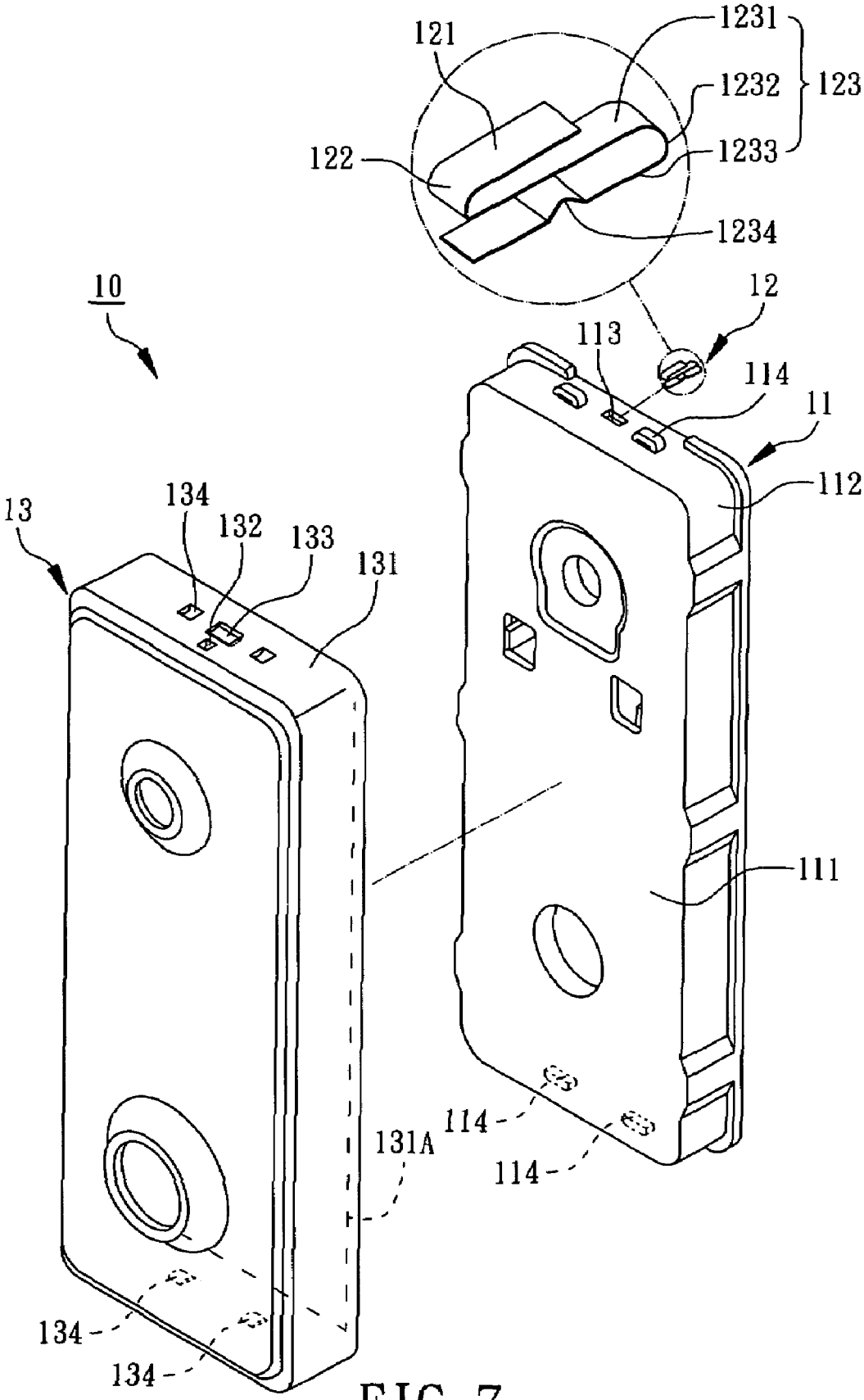
FIG. 7 is the structure diagram of another escutcheon in accordance with the present invention.

Referring to FIG. 6, if the escutcheon 13 is intentionally going to be removed from the base plate 11, a fastener-releasing tool (not showed in the drawings) is utilized to push the fastening portion 121 of the fastener 12 through the opening 132 of the escutcheon 13 that allows the limited-portion 133 to disengage from the limiting of the fastening portion 121 of the fastener 12 thereby completing fastener-releasing step. Next, the engaging bump 134 of the escutcheon 13 is enforced to disengage with the position bump 114 of the base plate 11 by adding an external force to the escutcheon 13 and then the escutcheon 13 can be removed from the base plate 11. In this embodiment, the opening 132 of the escutcheon 13 is utilized to expose the fastening portion 121 of the fastener 12 for releasing fastener. Accordingly, in another embodiment referring to FIG. 7, the opening 132 of the escutcheon 13 and the limited-portion 133 can be installed separately.

Figure 8:
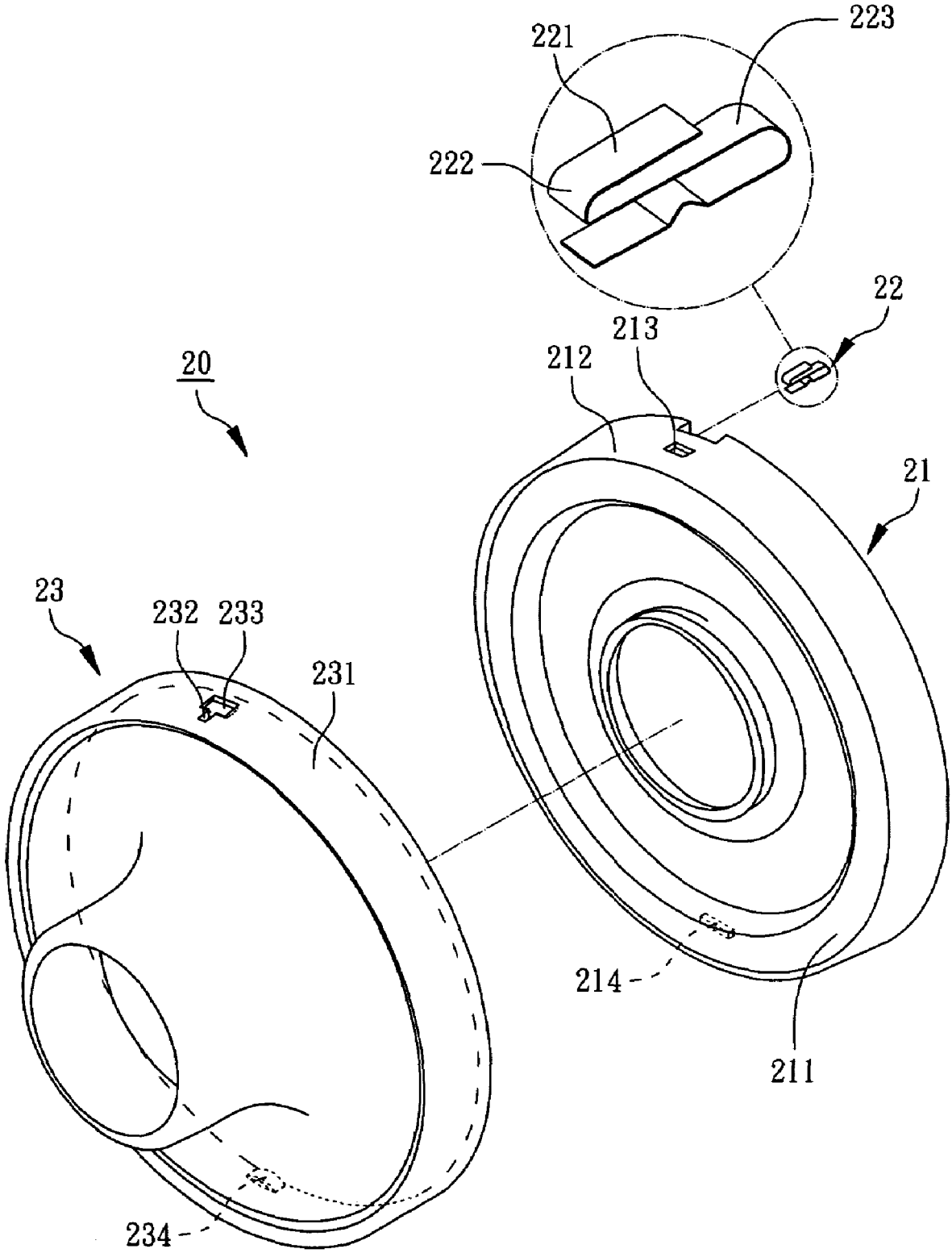
FIG. 8 is a block decomposition diagram of a combination structure of base plate and escutcheon in accordance with the second preferred embodiment of the present invention.

In the second preferred embodiment of the present invention showed in FIG. 8, a combination structure of base plate and escutcheon 20 comprises a circular base plate 21, a fastener 22 and a circular escutcheon 23. The circular base plate 21 has a plate 211 and a ring-like wall 212 surrounding the plate 211, a position hole 213 and a position bump 214, wherein the position hole 213 and the position bump 214 are formed on the ring-like wall 212. The fastener 22 has a fastening portion 221, a flexible portion 222 and a fixing portion 223, wherein the flexible portion 222 connects the fastening portion 221 and the fixing portion 223, the fixing portion 223 is installed on the ring-like wall 212 and corresponds to the position hole 213. The circular base plate 21 is covered with the circular escutcheon 23 and the circular escutcheon 23 has a sidewall 231, an opening 232, a limited-portion 233 and at least one engaging bump 234. The opening 232 is formed on the sidewall 231 and exposes the fastening portion 221 of the fastener 22. The limited-portion 233 is restrained by the fastening portion 221 of the fastener 22, and the engaging bump 234 engages with the position bump 214 of the circular base plate 21. The structure and assembling method of this embodiment is basically as same as those of the first preferred embodiment so that there is no need to describe herein again.

While the present invention has been particularly illustrated and described in detail with respect to the preferred embodiments thereof, it will be clearly understood by those skilled in the art that various changed in form and details may be made without departing from the spirit and scope of the present invention.

What is claimed is:

1. A combination structure of base plate and escutcheon comprising:

a base plate having a plate and a ring wall surrounding the plate;

an escutcheon covered on the base plate and having a sidewall, an opening and a limited-portion being formed on the sidewall, wherein the limited portion is a protrusion formed on an inner side of the sidewall; and a fastener having a fastening portion, a fixing portion and a flexible portion connecting the fastening portion and the fixing portion, the fixing portion being installed on the ring wall, the protrusion being restrained by the fastening portion for preventing the escutcheon being disengaged from the base plate, wherein the fixing portion of the fastener has a first clip arm, a bending portion and a second clip arm, the bending portion connects the first clip arm and the second clip arm, the base plate further comprises at least one position hole formed on the ring wall that accepts a position protruding portion located on the second clip arm of the fixing portion so as to retain the structure in place in combination with the protrusion acting on the fastening portion.

2. The combination structure of base plate and escutcheon in accordance with claim 1, wherein the fastening portion of the fastener has a bend-protruding portion that engages with the opening of the escutcheon and restrains the limited-portion.

3. The combination structure of base plate and escutcheon in accordance with claim 2, wherein the bend-protruding portion has a limited-end and the limited-portion of the escutcheon can be restrained by the limited-end.

* * * * *